US005678432A

United States Patent [19]

Teskey

[11] Patent Number: 5,678,432

[45] Date of Patent: Oct. 21, 1997

[54] EXTENDED THROW DEADBOLT LOCK ASSEMBLY

[75] Inventor: Gregg Teskey, 10867 Portal Dr., Los Alamitos, Calif. 90720

[73] Assignee: Gregg Teskey, Los Alamitos, Calif.

[21] Appl. No.: 504,443

[22] Filed: Jul. 20, 1995

[51] Int. Cl.[6] ..... E05B 65/06

[52] U.S. Cl. ..... 70/134; 70/143; 70/417

[58] Field of Search ..... 70/134, 143, 417, 70/110

[56] References Cited

U.S. PATENT DOCUMENTS

| | | | |
|---|---|---|---|
| 3,266,276 | 8/1966 | Yulkawski | 70/110 |
| 3,820,360 | 6/1974 | Best | 70/417 X |
| 4,656,849 | 4/1987 | Rotondi et al. | 70/143 X |
| 4,691,543 | 9/1987 | Watts | 70/143 |
| 4,887,442 | 12/1989 | Lavelle | 70/143 |
| 5,201,200 | 4/1993 | Hauber | 70/143 X |
| 5,368,345 | 11/1994 | Watts | 70/143 X |
| 5,469,723 | 11/1995 | Utwin et al. | 70/143 X |

*Primary Examiner*—Suzanne Dino
*Attorney, Agent, or Firm*—Fulwider Patton Lee & Utecht, LLP

[57] ABSTRACT

An extended throw deadbolt lock including a housing having a face plate and an axial guide channel formed with a guide path having spaced apart locking seats. Angled transition surfaces extend toward each of the locking seats. A deadbolt member having a transverse locking member slot is mounted within the guide channel and a locking member, including a locking tab disposed in the guide path, is mounted within the locking member slot. A key cylinder having a rotatable cam is mounted on the housing. When the key cylinder is rotated, the cam engages the locking member to drive the locking tab from a locking seat and engage an abutment wall of the deadbolt member slot to drive the deadbolt member in the guide channel such that the tab moves in the guide path toward the other locking seat. At one point, the cam disengages the wall of the slot whereupon a biasing member, having a biasing force, biases the locking tab along the angled transition redirecting the biasing force against the wall of the slot to further drive the deadbolt member in the guide channel an extended distance. The tab is driven along the angled surface far enough so that locking tab is received in the other of the locking seats to lock the deadbolt member in position.

5 Claims, 3 Drawing Sheets

EXTENDED THROW DEADBOLT LOCK ASSEMBLY

BACKGROUND

The invention is generally related to locking devices and more particularly, to deadbolt-type locking devices.

Deadbolt-type locking devices have been incorporated in doors and the like for a number of years and have gained consumer confidence in providing security for both residences and businesses.

Deadbolt-type locking devices are typically mounted in a receptacle or in a cut-out formed in the side portion of the door. Many newly manufactured doors are provided with prefabricated receptacles to facilitate rapid installation of locking devices in the field. Because of this practice, manufacturers of doors have standardized the dimensions of the prefabricated receptacle limiting the size of the locking device that may be installed therein without having to modify the dimensions of the receptacle. In solid faced doors, the dimension of the receptacle may be modified to incorporate many different depth locking devices because the width of the door is not critically limited.

However, when mounting the deadbolt locking device within the hollow peripheral frame of a glass door, the depth of the receptacle for receiving the deadbolt locking device is limited because the peripheral frame usually is relatively slim having a predetermined width. Therefore, the depth of the prefabricated receptacle is usually not readily modifiable and the lock hardware installer must utilize a deadbolt locking device fitting the predetermined dimensions of the prefabricated receptacle.

In glass door frames the depth of the receptacle is typically standardized at 1⅞ inches and thus the depth of the housing of the deadbolt locking device is restricted to that dimension. Because of the limited depth of the deadbolt housing, the typical extension of the bolt from the face plate of the deadbolt locking device is usually on the order of only three-quarters (¾) of an inch.

In particular instances where the deadbolt locking device is to be installed in a glass door, the door may be only provided with top and bottom framing rails in which the bottom rail is configured to receive the deadbolt. In such configuration, the bolt travels vertically from its retracted position to a downward position where it may be received within the bore of a strike plate grouted or otherwise cemented within the floor and disposed at the floor surface. Because of sloping imperfections usually inherent of the surface of the floor, the distance between the face plate and the strike bore under the bolt may be spaced such that the bolt, when extended, is not received far enough within the bore of the strike plate to provide secure engagement therein. Therefore, it is desirable to provide a deadbolt locking device having a longer bolt and an extended bolt throw such that the bolt may be sufficiently advanced within the strike plate bore to provide additional secure lateral engagement between the bolt and the strike plate.

Because the extended throw deadbolt locking device incorporates the longer bolt, the moment or bending forces imposed by the strike plate bore acting on the bolt may be increased. Therefore, it is desirable that the longer bolt be reinforced to provide sufficient strength to overcome such increased moment and bending forces.

Hence, those skilled in the art have recognized the need for a locking device receivable within a standard size receptacle prefabricated in a door that includes a relatively longer bolt and a mechanism that provides for extended bolt throw. The bolt of the locking device should be reinforced to withstand greater bending and moment forces that the extended throw bolt may encounter. In addition, the locking device should be relatively inexpensive to manufacture and reliable in use. The present invention meets these needs and others.

SUMMARY OF THE INVENTION

The present invention is directed to a deadbolt locking device having a mechanism disposed within the confines of a housing having a predetermined depth that provides for extended relative displacement of an elongated bolt member.

The deadbolt locking device includes a housing having a face plate including an axial bolt member bore and a pair of laterally spaced apart side walls. The side walls extend from the face plate and include an axial guide channel formed between the walls. One of the side walls adjacent the channel is formed with a guide path having first and second spaced apart locking seats separated by a dividing member that partially closes the guide path. The dividing member is formed with a first angled transition surface extending toward the first locking seat and a second angled transition surface extending toward the second locking seat.

A deadbolt member is mounted within the guide channel having an elongated reinforced bolt member received in the bolt member bore and a transverse locking member slot to define axially spaced apart abutment walls. The deadbolt member is movable in the guide channel such that the bolt member may extend outwardly from the face plate.

A locking member is mounted within the locking member slot and includes a locking tab disposed in the guide path. The locking member is biased in the locking member slot with a biasing force such that the locking tab may be received in one of the locking seats.

A key cylinder having a rotatable cam is mounted on the housing.

When the locking tab is positioned in one of the locking seats and the key cylinder is rotated, the cam rotates to engage the locking member driving the locking tab from that locking seat. Upon further rotation of the cam, the cam engages one of the abutment walls of the deadbolt member to drive the deadbolt member in the housing guide channel such that the tab moves in the guide path past the dividing member. The deadbolt member moves far enough such that the cam disengages the one abutment wall, whereupon the biasing member biases the locking member such that the locking tab is driven along the one angled transition surface. The angled transition surface redirects the biasing force to the one abutment wall to further drive the deadbolt member in the guide channel. The locking tab is driven along the angled transition such that the locking tab is received in the other of the locking seats to lock the deadbolt member in position.

The subject invention provides for a one and one-sixteenth inch (1 1/16") bolt displacement or throw from the same size housing (1⅞") which only provides for a three-quarter inch (¾") throw in prior devices.

In accordance with one aspect of the invention, the bolt of the deadbolt member is formed with an axial bore and a reinforcing dowel is received in the axial bore to supply additional bolt strength. More particularly, the bolt may be composed of brass and the dowel is may be composed of hardened steel.

Other features and advantages of the invention will become apparent from the following detailed description taken in conjunction with the accompanying drawings, which illustrate by way of example, the features and advantages of the invention.

DETAILED DESCRIPTION OF THE PREFERRED EMBODIMENT

Figure 3:
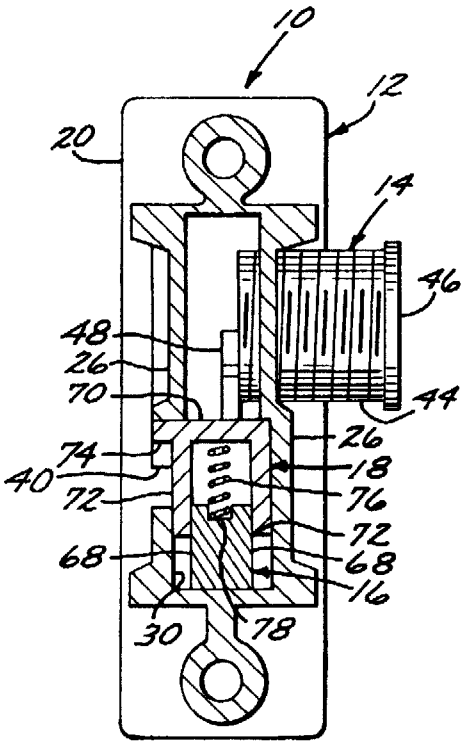
FIG. 3 is a partial sectional rear view of the deadbolt locking device taken along line 3—3 of FIG. 2.
Figure 2:
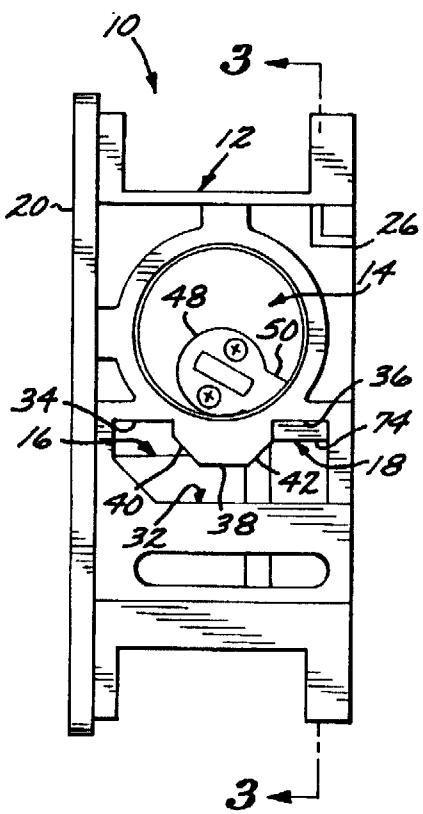
FIG. 2 is a side view of the deadbolt locking device shown in FIG. 1.
Figure 1:
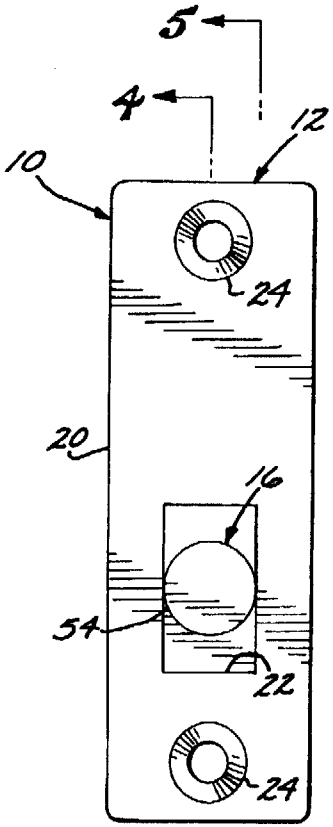
FIG. 1 is a front view of a deadbolt locking device in accordance with the present invention.

In the following description, like reference numerals will be used to refer to like or corresponding elements in the different figures of the drawings. Referring to FIGS. 1, 2, and 3, there is shown a deadbolt locking device 10 embodying features of the invention. Briefly, the locking device includes a housing 12, a key cylinder 14, a deadbolt member 16, and a locking device 18 that holds the deadbolt member in a retracted or fully extended position. The deadbolt locking device is suitable for mounting within a receptacle or cut-out formed in the side wall of a door, and more particularly within a receptacle formed in a peripheral frame or edge of a glass door.

The components of the deadbolt locking device 10 cooperate to provide an extended throw feature whereby the deadbolt member 16 may be displaced a relative extended distance such that more of the deadbolt member may be engaged with a strike plate bore affixed to a door frame or affixed to the surface of the floor to provide enhanced locking engagement therebetween. This feature is desirable in deadbolt locking devices wherein the dimensions of the device are limited to standard prefabricated receptacles or cut-out dimensions provided in the side wall of the door or the peripheral frame of a glass door.

The terms "upper", "lower", "front" and "rear" are used hereinafter for convenience in describing the elements of the deadbolt locking device 10 and are to be by no means limiting because the locking device may effectively operate in any orientation. Referring to FIGS. 1 through 3, the housing 12 includes an elongated rectangular face plate 20 having a rectangular axial bore 22 formed therethrough generally at the center thereof, the longitudinal dimension of the rectangular bore aligned longitudinally with the face plate. A pair of countersunk axial mounting holes 24 are formed at the opposite longitudinal upper and lower ends of the face plate. Extending rearwardly in the axial direction from the face plate are a pair of generally rectangular, laterally spaced apart side walls 26.

With particular reference to FIG. 3, the upper end of the respective housing side walls 26 are formed with a pair of relatively large diameter transverse threaded cylinder bores 28 for selectively mounting key cylinder 14 to the housing. The lower end of the respective inwardly facing side walls are formed with respective squared off opposed recesses that form a rectangular deadbolt member guide channel 30 extending axially from the face plate 20 to the rear end of the housing 12.

Referring now to FIG. 2, one of the housing side walls 26 is formed therethrough with a locking member guide path, generally indicated at 32. The guide path is formed adjacent the guide channel 30 and is generally aligned in the axial direction. The guide path is formed with axially spaced apart, generally rectangular locking member seats, a first seat 34 disposed at the front end of the guide path near the face plate 20 and a second seat 36 disposed at the rear end of the guide path. The respective seats are separated by a dividing member 38 projecting downwardly into the guide path to partially close the guide path. The front and rear opposite ends of the dividing member are formed with a pair of angled camming surfaces, a first angled surface 40 sloping upwardly and rearwardly toward the first locking member seat 34 and a second angled surface sloping upwardly and forwardly toward the second locking seat 36. The housing may be composed of brass and may be cast molded using processes known well in the art.

Referring to FIG. 3, the key cylinder 14 is a conventional mortis-type, key operated device having a threaded cylindrical body 44 with an outer key receiving end 46 and an inner end mounting a standard sized rotatable cam 48 operable upon rotation of a key (not shown). The inner end of the cylindrical body is threadedly engaged to one of the key cylinder bores 28 formed in one of the side walls 26 such that the cam is disposed generally at the geometric center of the housing 12. The key cylinder shown in FIG. 3 is mounted on the right hand side of the housing 12, but may be mounted in either of the key cylinder bores depending on the orientation desired so that operation of the deadbolt locking device 10 may be made from either lateral opposite side of the housing. The cam 48 includes radially projecting cam arm 50 having a radial length selected such that upon rotation, the cam arm does not pass outside the axial rear dimension of the housing 12.

Figure 4:
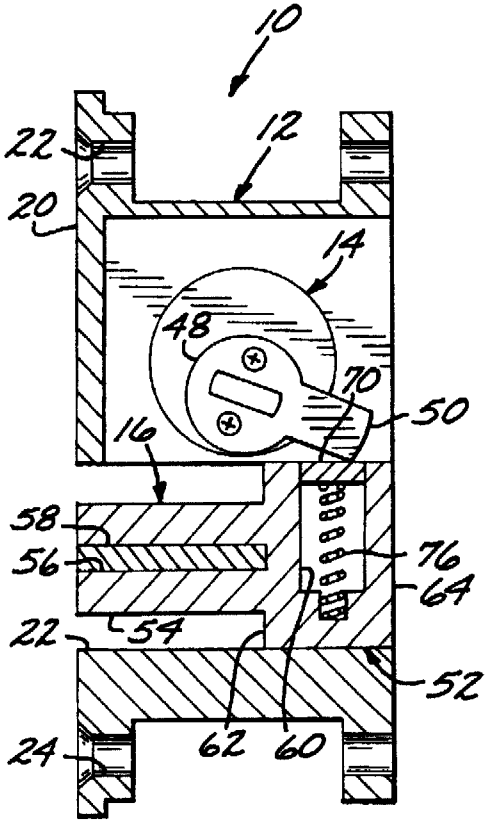
FIG. 4 is a partial sectional side view of the deadbolt locking device taken along line 4—4 of FIG. 1, showing the deadbolt member thereof in its locked retracted position.

Referring particularly to FIG. 4, the deadbolt member 16 will now be described in detail. The deadbolt member includes a generally rectangular guide block 52 at the back end thereof and an elongated cylindrical bolt 54 extending forwardly from the guide block. The bolt is formed with an axial through bore 56 sized for receipt of an elongated cylindrical reinforcing member dowel 58. The guide block 52 is formed with an upwardly opening, vertical locking member slot 60 to define a forward abutment wall 62 and a rear abutment wall 64. The slot is sized for the slidable receipt of the locking member 18 therein. The upper ends of the respective abutment walls are formed with upwardly and outwardly diverging tapers 66. Extending downwardly from the lower surface of the locking member slot are a pair of laterally spaced apart locking member grooves 68 (FIG. 3). The deadbolt member is received within the guide channel 30 of the housing 12 wherein the forward end of the bolt is received in the face plate bore 22 and the guide block is received within the guide channel.

The deadbolt member 16 may be composed of brass and may be cast molded using processes known well to those skilled in the art. The reinforcing member 58 may be composed of hardened steel and affixed within the bore 56 by press fitting or by threaded connection.

With reference to FIG. 3 and 4, the locking member 18 will be hereinafter described. As shown in FIG. 3, the locking member is U-shaped having a flat head 70 and laterally spaced apart downwardly turned legs 72. Projecting laterally outwardly from the locking member head and into the guide path 32 is a generally rectangular locking tab 74 sized for receipt within the first or second locking seats 34 or 36 (FIG. 2). The legs of the locking member are sized for receipt within the grooves 68 of the deadbolt member. A biasing member, or more particularly a coil spring 76, is interposed between the bottom of the slot of the deadbolt member and the bottom surface of the head 70 of the locking member to bias the locking member upwardly. The bottom end of the spring is disposed within a vertical spring hole 78 formed centrally in the bottom end of the locking member slot 60.

Referring now to FIGS. 2 and 4 through 8, the operation of the deadbolt locking device 10 may be described in detail. As shown in FIGS. 2 and 4, the deadbolt member 16 is in its retracted state wherein the locking tab 74 of the locking member 18 is disposed within the second locking seat 36 of the housing guide path 32. As such, the locking tab prevents the deadbolt member from being moved axially due to the engagement of the seat 36 and the locking tab 74 and engagement of the locking member 18 with the locking member slot 60 of the deadbolt member.

Figure 5:
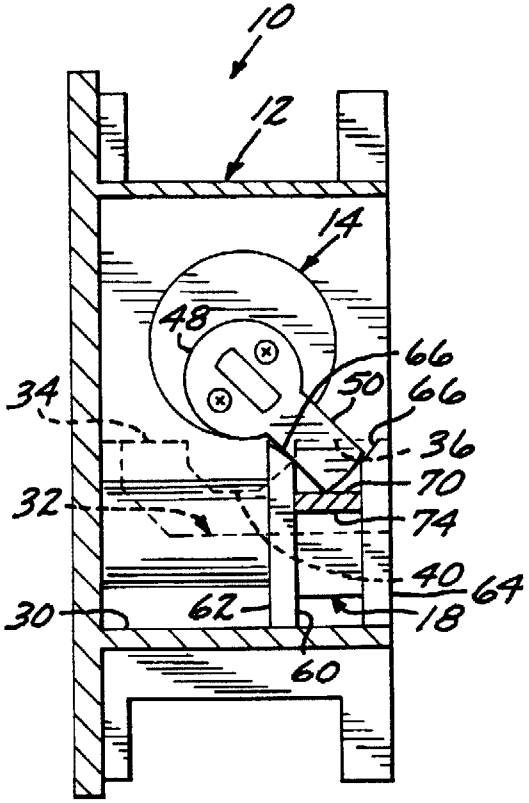
FIG. 5 is a partial sectional side view of the deadbolt locking device taken along line 5—5 of FIG. 1 showing the key cylinder thereof partially rotated to unlock the deadbolt member from its retracted position.

Referring to FIG. 5, to extend the bolt 54 of the deadbolt member 16, the cam 48 of the key cylinder 14 is turned by the key (not shown). As shown, the cam rotates clockwise and the cam arm 50 thereof engages the head 70 of the locking member 18 to depress the locking member vertically within the locking member slot 60 of the deadbolt member 16, compressing the spring 76 (FIG. 4). The locking member is depressed far enough such that the locking tab 74 is clear of the second locking seat 36 and is disposed below the bottom surface of the dividing member 38 to be axially aligned within the guide path 32. The locking tab of the locking member drops vertically and does not slide along the second angled surface 42. At this point, the cam arm engages the tapered surface 66 of the front abutment wall 62 of the deadbolt member, the distal portion of the cam arm passing by the rear abutment wall 64 and tapered surface 66 thereof.

Figure 6:
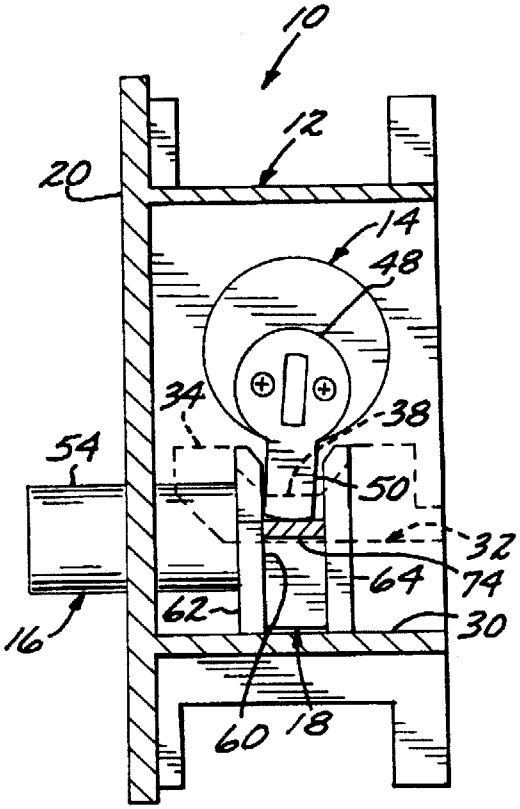
FIG. 6 is a partial sectional side view of the deadbolt locking device similar to FIG. 5, but showing the key cylinder further rotated to move the deadbolt member outwardly in a partially extended position.

Referring now to FIG. 6, upon further clockwise rotation of the cam 48, the cam arm 50 engages the front abutment wall 62 of the deadbolt member 16 to move the deadbolt member forwardly within the guide channel 30 of the housing 12 toward the front end of the housing partially extending the bolt 54 from the face plate 20. Simultaneously, the cam arm further depresses the locking member 18 within the locking member slot 60 of the deadbolt member such that the locking tab 74 passes clear of the dividing member 38 and moves forwardly in the guide path 32.

Figure 7:
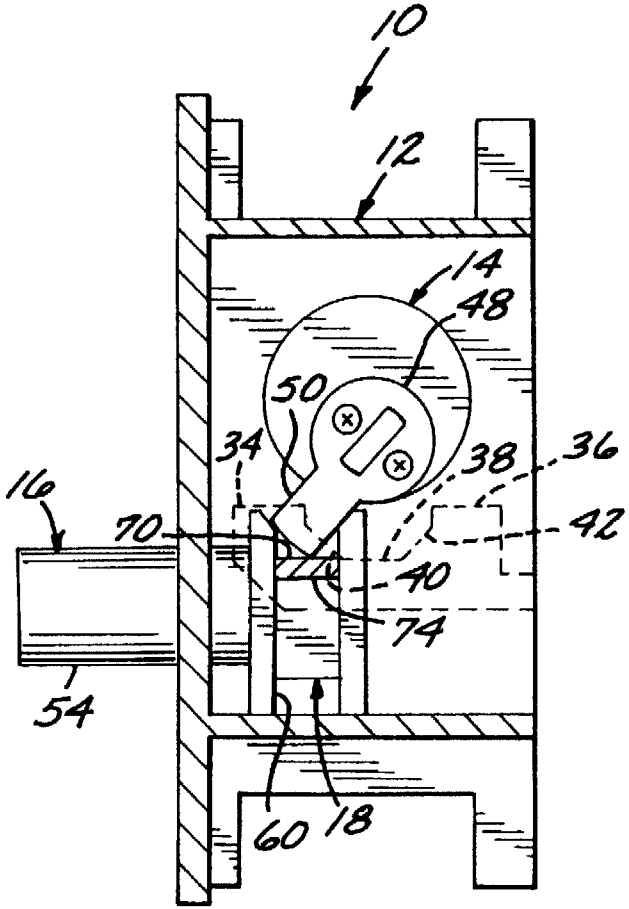
FIG. 7 is a partial sectional side view of the deadbolt locking device similar to FIG. 6, but showing the key cylinder further rotated to move the deadbolt member further in the outward direction.

Upon further clockwise rotation of the cam 48, as shown in FIG. 7, the cam arm 50 further pushes the front abutment wall 62 to move the deadbolt member 16 and further extend the bolt 54 from the face plate 20 of the housing 12. The spring 76 biases the head 70 of the locking member 18 to move the locking member upwardly within the locking member slot 60. At this point, the locking tab 74 of the locking member engages the second angled surface 42 of the dividing member 38, and the tapered surface 66 of the rear abutment wall 64 of the deadbolt member moves into engagement with the trailing edge of the cam arm. The distal extremity of the cam arm is free thereby free of the locking member slot 60 and the tapered surface 66 of the front abutment wall 62. As such, further rotation of the cam does not impart any forces or movement against the deadbolt member 16.

Figure 8:
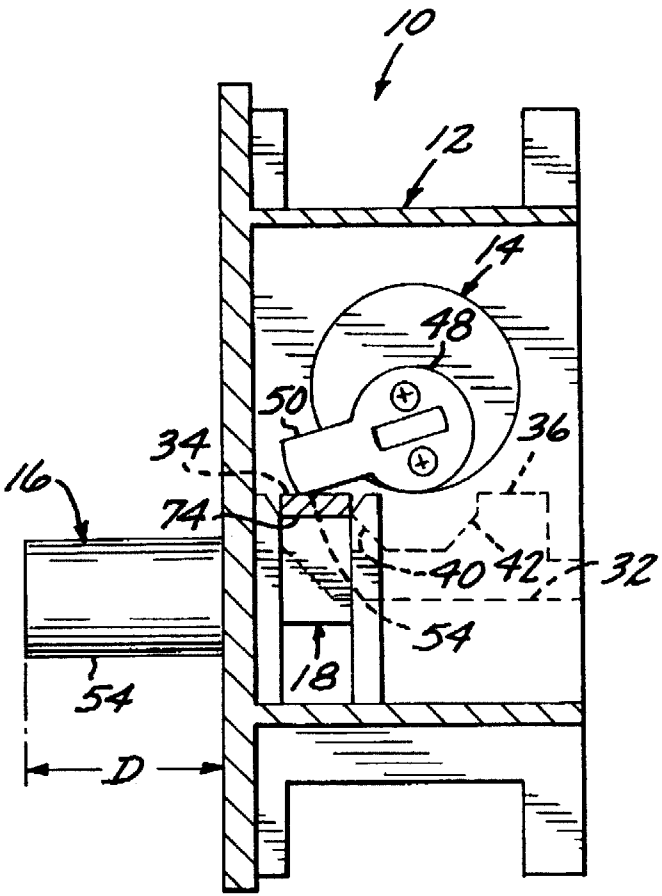
FIG. 8 is a partial sectional side view of the deadbolt locking device similar to FIG. 7, but showing the deadbolt member in its fully extended locked position.

Referring now to FIG. 8, upon further rotation of the cam 48, the cam arm 50 is completely free of the locking member slot 60 and moves upwardly therefrom losing contact with the head 70 of the locking member 18. The biasing force of the spring 76 moves the locking member 18 upwardly in the locking member slot 60 to urge the locking tab 74 thereof upwardly against the first angled surface 40 of the housing guide path 32, the first angled surface redirecting that biasing force axially such that the forward end of the locking member engages the pushing wall 68 of the deadbolt member 16. This biasing force further urges the deadbolt member in the forward axial direction within the guide channel 30 to further extend the bolt 54 outwardly from the face plate 20. The locking tab slides along the angled surface until the locking tab is received within the first locking seat 34 of the guide path 32. Due to the confrontation of the seat 34 with the locking tab and due to the confrontation of the locking member 18 with the locking member slot 60 of the deadbolt member, the deadbolt member is prevented from being moved axially. The deadbolt member is now in its locked, fully extended position.

With reference to FIG. 7, to retract the bolt 54 of the deadbolt member 16 within the housing 12, the key may be actuated to rotate the cam 48 in the opposite counter clockwise direction. As the cam rotates, the cam arm 50 thereof engages the head 70 of the locking member 18 to depress the locking member within the locking member slot 60 of the deadbolt member 16, compressing the spring 76. The locking member is depressed far enough such that the locking tab 74 is clear of the first locking seat 34 and is disposed below the bottom surface of the dividing member 38 and axially aligned within the guide path 32. At this point, the cam arm engages the tapered surface 66 of the rear abutment wall 64 of the deadbolt member, the distal portion of the cam arm passing by the front abutment wall 62 and tapered surface 66 thereof.

Upon further counter-clockwise rotation of the cam 48, the cam arm 50 engages the rear abutment wall 64 of the deadbolt member 16 to move the deadbolt member rearwardly within the guide channel 30 of the housing 12 to partially retract the bolt 54 within the housing and face plate 20. Simultaneously, the cam arm further depresses the locking member 18 vertically within the locking member slot 60 of the deadbolt member such that the locking tab 74 passes clear of the dividing member 38 and moves rearwardly through the guide path 32.

Upon further counter-clockwise rotation of the cam 48 the cam arm 50 applies force to the rear abutment wall 64 to move the deadbolt member 16 and further retract the bolt member 16 within the housing 12 and retract the bolt 54 from the face plate 20. The spring 76 biases the head 70 of the locking member 18 to move the locking member upwardly within the locking member slot 60. At this point, the locking tab 74 of the locking member engages the second angled surface 42 of the dividing member 38, and the tapered surface 66 of the rear abutment wall 62 of the deadbolt member moves into engagement with the trailing edge of the cam arm. The distal extremity of the cam arm is thereby free of the locking member slot 60 and the tapered surface 66 of the rear abutment wall 64. As such, further rotation of the cam does not impart any forces against the deadbolt member 16.

Upon further counter-clockwise rotation of the cam 48, the cam arm 50 is completely free of the locking member slot 60 and moves upwardly therefrom losing contact with the head 70 of the locking member 18. The biasing force of the spring 76 engages the head 70 of the locking member 18 urges the locking tab 74 thereof upwardly against the second angled surface 42 of the housing guide path 32, the first angled surface redirecting that biasing force axially such that the rear end of the locking member engages the rear abutment wall 64 of the deadbolt member 16 to further urge the deadbolt member in the rearward axial direction in the guide channel 30 to further retract the deadbolt member within the housing and retract the bolt 54 within the face plate 20. The locking tab 74 slides along the first angled surface until the locking tab 74 is received within the second locking seat 36 of the guide path 32. The deadbolt member is now in its locked fully retracted position.

Because of the predetermined depth of the prefabricated receptacle formed in the peripheral frame of the glass door, wherein the deadbolt locking device 10 is to be mounted and received, the radial length of the cam arm 50 is limited due to the physical geometrical constraints of the deadbolt housing 12 within which the cam 48 must rotate. In particular, the axial width or depth of the housing 12 restricts the length of the cam arm because the radial extremity of the cam arm, when rotated, must pass within the dimensions of the housing. Because the length of the cam arm is limited, the axial travel of the deadbolt member due to forces imparted by the cam arm to the deadbolt member, is thereby limited. Therefore, it is to be appreciated that the biasing force and action of the spring 76 to further urge the deadbolt member 16 within the guide channel 30 of the housing 12 provides for additional displacement of the deadbolt member. This additional displacement allows the deadbolt member to be displaced to its fully extended and fully retracted positions. As such, the bolt 54 is configured to provide an extended displacement or throw from the face plate 20. In the preferred configuration, the bolt 54 may be operatively extended a distance "D" of one and one-sixteenth inches (1 1/16") from the face plate wherein the depth or axial width of the housing is merely 1 7/8 inches. This provides an improvement over prior devices which were limited to a 3/4" displacement or throw for a similar sized housing.

The bolt 54 of the deadbolt member 16 may therefore be extended to one and one-sixteenth inches (1 1/16") such that the bolt may extend into locking engagement with a locking bore of a strike plate that might otherwise be spaced too far away for secure engagement therewith. Otherwise, the extended length bolt may provide for greater receipt within the strike plate bore to enhanced locking engagement therewith. Because an extended length bolt is now provided, the bolt may be subjected to greater bending or moment forces when lateral forces are placed upon the bolt. As such, the reinforcement member or dowel 58 (FIG. 4) received in the bolt 54 provides additional bending strength and rigidity to the bolt to overcome such increased bending force.

From the foregoing, it will be appreciated that the deadbolt locking device 10 of the invention provides for extended deadbolt throw wherein the deadbolt is confined within a housing having its dimensions constrained to that of a receptacle having a predetermined depth over the throw of prior devices having similar predetermined depth. The bolt of the deadbolt locking device may be reinforced to provide additional structural rigidity for countering possible increased bending forces that may be imparted to the bolt in while operation. In addition, the deadbolt locking device is relatively inexpensive to manufacture and is reliable in use.

While particular forms of the invention have been illustrated and described, various modifications can be made without departing from the spirit and scope of the invention. Accordingly, it is not intended that the invention be limited, except as by the appended claims.

What is claimed is:

1. An extended throw deadbolt lock comprising:

a housing having a face plate including an axial bolt member bore and a pair of laterally spaced apart side walls extending from said face plate including an axial guide channel formed between said walls, wherein one of said side walls adjacent said channel is formed with a guide path having first and second spaced apart locking seats separated by a dividing member partially closing said guide path, said dividing member formed with a first angled transition surface extending toward said first locking seat and a second angled transition surface extending toward said second locking seat;

a key cylinder mounted in said housing, said cylinder having a rotatable cam assembly;

a deadbolt member mounted within said guide channel and having an elongated bolt member received in said bolt member bore and a transverse locking member slot to define axially spaced apart abutment walls, said deadbolt member being movable in said guide channel such that said bolt member may extend outwardly from said face plate; and a locking member mounted within said locking member slot and including a locking tab disposed in said guide path, said locking member biased in said locking member slot with a biasing force such that said locking tab may be received in one of said locking seats and wherein when said tab is received in said first locking seat said bolt member is not extended from said face plate and when said tab is in said second locking seat, said bolt is extended from said face plate;

whereby when said locking tab is positioned in one of said locking seats and said cam assembly is rotated, said cam assembly engages said locking member to drive said locking tab from said locking seat, and upon further rotation of said cam assembly, said cam assembly engages one of said abutment walls of said deadbolt member to drive said deadbolt member in said housing guide channel such that said tab moves in said guide path past said dividing member and said cam assembly disengages said one abutment wall, whereupon said biasing member biases said locking member such that said locking tab is driven along said one angled transition to redirect said biasing force such that said locking member engages said one abutment wall to further drive said deadbolt member in said guide channel and such that said locking tab is received in the other of said locking seats to lock said deadbolt member in position.

2. The deadbolt lock of claim 1 wherein:

said bolt of said deadbolt member includes an axial bore and further including:

a reinforcing dowel received in said axial bore.

3. The deadbolt lock of claim 2 wherein:

said bolt is composed of brass and said dowel is composed of hardened steel.

4. An extended throw deadbolt lock comprising:

a housing having a face plate including an axial bolt member bore and a pair of laterally spaced apart side walls extending from said face plate including an axial guide channel formed between said walls, wherein one of said side walls is formed in a predetermined location with a guide path having first and second spaced apart locking seats separated by a dividing member partially closing said guide path, said dividing member formed with a first angled transition surface extending toward said first locking seat and a second angled transition surface extending toward said second locking seat;

a key cylinder mounted in said housing, said cylinder having a rotatable cam assembly;

a deadbolt member slidably received within said guide channel and having an elongated bolt member at one end received in said bolt member bore and a transverse slot adjacent the other end defining axially spaced apart abutment walls; and a locking member housed at least partially within said locking member slot and biased outwardly from said slot, said locking member including a locking tab for travel in said guide path, said locking member being disposed at a predetermined position in said housing to normally nest said locking tab in one of said locking seats and such that said locking member is engaged by said cam assembly during rotation thereof and driven against the bias applied thereto to displace said locking tab from said locking seat, said cam assembly further engaging one of said abutment walls during rotation thereof to displace said bolt relative to said housing a predetermined length, said locking member and one of said angled transitional surfaces cooperating when said cam assembly disengages said locking member to further displace said bolt relative to said housing.

5. An extended throw deadbolt lock comprising:

a housing having a face plate including an axial bolt member bore and a pair of laterally spaced apart side walls extending from said face plate including an axial guide channel formed between said walls, wherein one of said side walls adjacent said channel is formed with a guide path having first and second spaced apart locking seats separated by a dividing member partially closing said guide path, said dividing member formed with a first angled transition surface extending toward said first locking seat and a second angled transition surface extending toward said second locking seat;

a key cylinder mounted in said housing, said cylinder having a rotatable cam;

a deadbolt member mounted within said guide channel having an elongated bolt member at one end received in said bolt member bore and a transverse slot at the other end defining axially spaced apart abutment walls, said bolt member including an axial bore having a reinforcing dowel affixed therein, and wherein said deadbolt member is movable in said guide channel such that said bolt member may extend outwardly from said face plate; and a locking member mounted within said locking member slot including a locking tab disposed in said guide path, said locking member biased in said locking member slot with a biasing force such that said locking tab may be received in one of said locking seats and wherein when said tab is received in said first locking seat said bolt member is not extended from said face plate and when said tab is in said second locking seat, said bolt is extended from said face plate;

whereby when said locking tab is positioned in one of said locking seats and said cam is rotated, said cam engages said locking member to drive said locking tab from that locking seat, and upon further rotation of said cam, said cam engages one of said abutment walls of said deadbolt member to drive said deadbolt member in said housing guide channel such that said tab moves in said guide path past said dividing member and said cam disengages said one abutment wall, whereupon said biasing member biases said locking member such that said locking tab is driven along said one angled transition to redirect said biasing force such that said locking member engages said one abutment wall to further drive said deadbolt member in said guide channel and such that said locking tab is received in the other of said locking seats to lock said deadbolt member in position.

* * * * *